United States Patent [19]

Harrington

[11] 4,073,236

[45] Feb. 14, 1978

[54] POWER AND FREE CONVEYOR SYSTEM

[75] Inventor: Earl J. Harrington, Ferndale, Mich.

[73] Assignee: Overhead Conveyor Company, Ferndale, Mich.

[21] Appl. No.: 687,673

[22] Filed: May 19, 1976

[51] Int. Cl.[2] ..... B61B 13/00

[52] U.S. Cl. ..... 104/172 S; 198/473; 198/685; 198/690

[58] Field of Search ..... 104/147 R, 162, 165, 104/172 RS, 148 MS, 148 R; 198/473, 619, 685, 690, 691, 679, 732, 733, 805; 46/235, 236, 240, 241, 242

[56] References Cited

U.S. PATENT DOCUMENTS

| | | | |
|---|---|---|---|
| 2,609,915 | 9/1952 | DeBurgh | 198/619 |
| 3,083,650 | 4/1963 | Peras | 104/172 S |
| 3,554,131 | 1/1971 | Radovic | 104/165 |
| 3,757,700 | 9/1973 | Nakagawa et al. | 104/165 |
| 3,872,963 | 3/1975 | Sherwood | 198/732 X |

*Primary Examiner*—Robert J. Spar
*Assistant Examiner*—Randolph A. Reese
*Attorney, Agent, or Firm*—Barnes, Kisselle, Raisch & Choate

[57] ABSTRACT

A power and free conveyor utilizing a drive chain and a load supporting track, both disposed in the same lineal direction with a magnetic pick up on the drive chain with pivotally mounted magnets which cooperate with an angled magnetic ramp on the load carrier such that motion of the magnets on the ramp effect a relatively noiseless contact therewith and a gradual acceleration of the load up to the chain velocity.

5 Claims, 4 Drawing Figures

Figure 1:
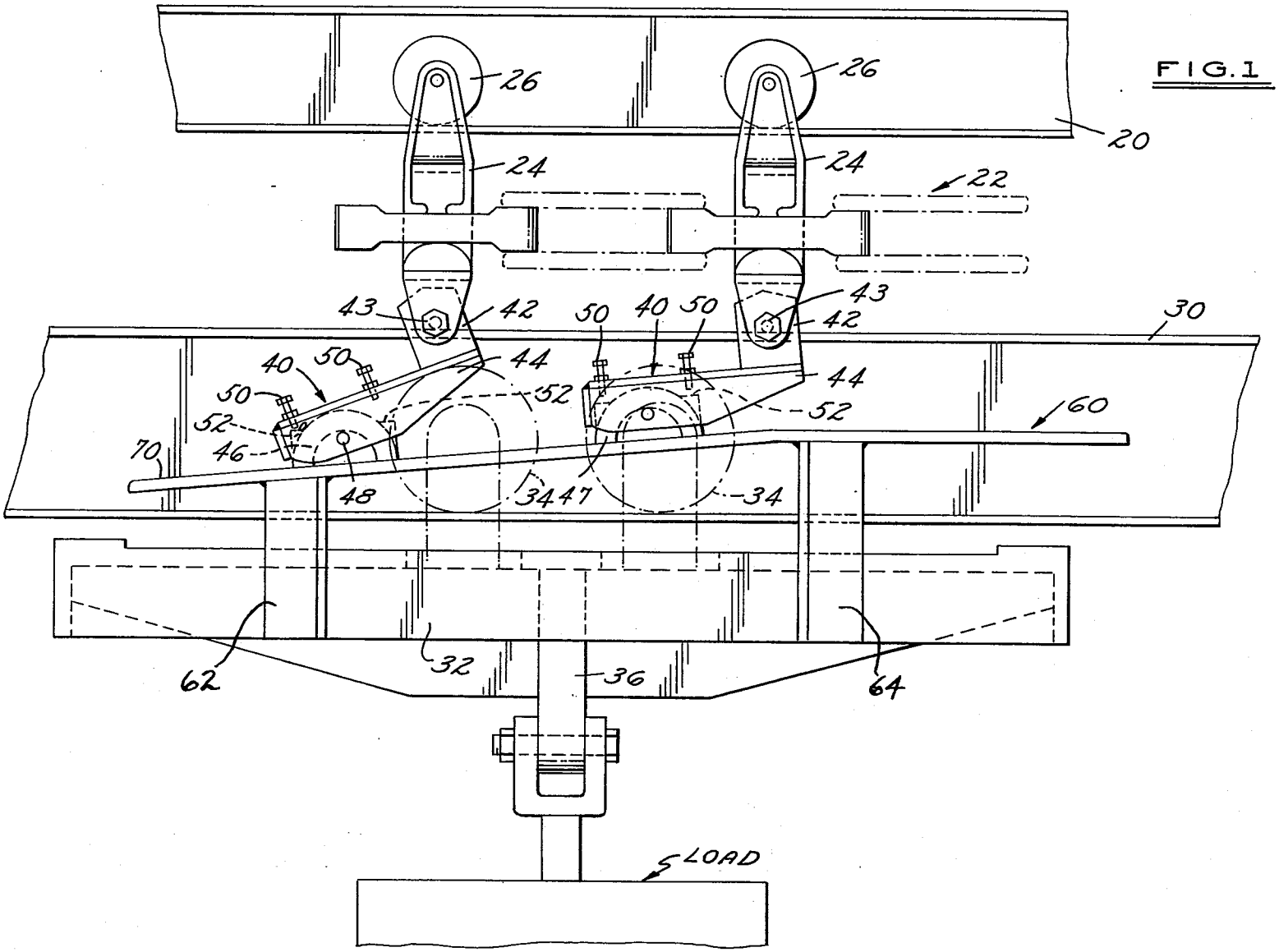

20
22
24
26
30
32
34
36
40
42
43
44
46
47
48
50
52
60
62
64
70
LOAD

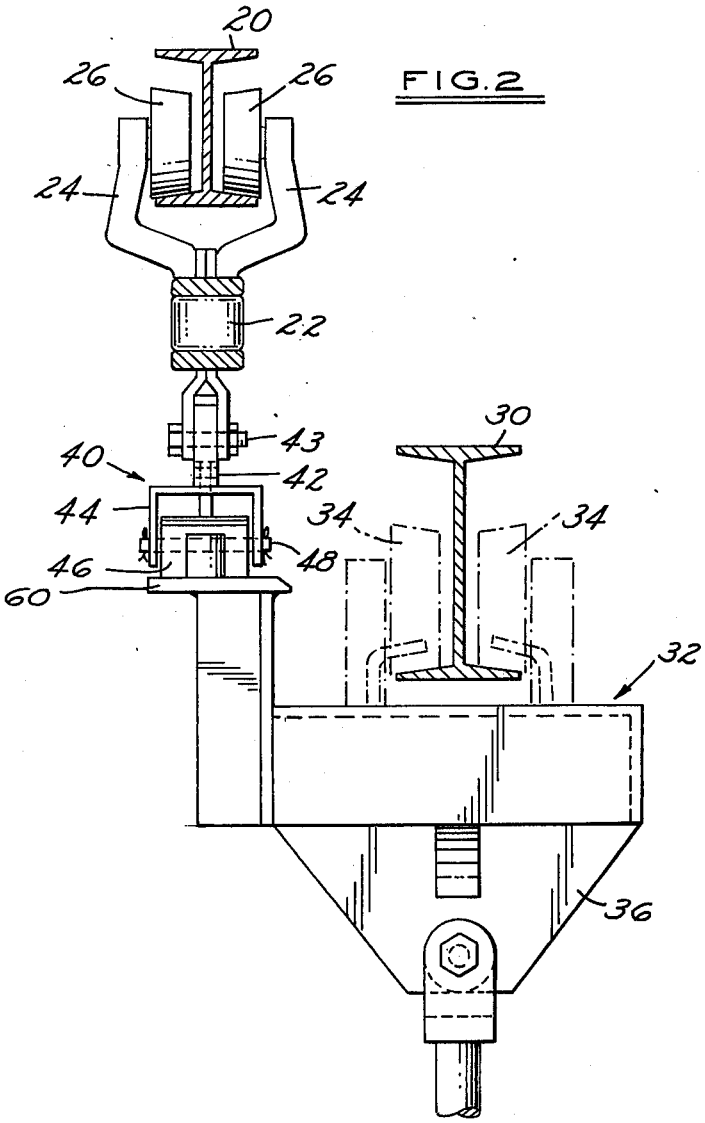
FIG. 2
FIG. 3
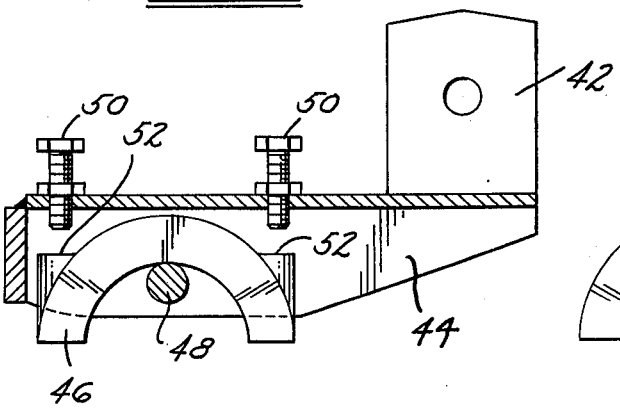
FIG. 4
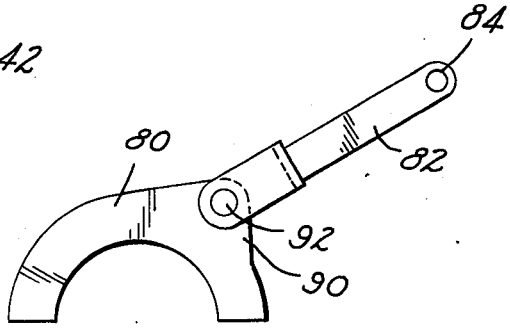

POWER AND FREE CONVEYOR SYSTEM

This invention relates to a Power and Free Conveyor System and more particularly to a conveyor system of this type which has a magnetic pick-up between the drive chain and the carrier elements. In a power and free conveyor system, it has been common to use mechanical dogs attached to a drive chain which will pick up and release carrier elements on a separate track. These mechanical elements are quite noisy; and in view of the recent trend toward reducing shop noise, there has been an objective to develop more silient devices for all operating equipment.

The present invention is directed to a magnetic pick-up means for conveyors which has a number of distinct advantages over previous devices including the magnetic devices. Reference is made to the following U.S. Pat. Nos. De Burgh 2,609,915 Sept. 9, 1952, Peras 3,083,650 Apr. 2, 1963, De Rose 2,650,217 Mar. 21, 1972. These patents show generally a magnetic device as used in conveyors and the present invention is intended to be an improvement over these structures and also the mechanical dog-type structures.

It is an object of the present invention to provide a magnetic pick up for conveyors wherein the magnet cams onto a drive surface or ramp and gradually accelerates the car to which the ramp is attached and finally moves it at the same speed as the drive chain. The drive magnets are so arranged that they slide quietly onto the ramp surface and thus avoid the clattering noise that is common in this type of conveyor. It will, of course, be possible to use the usual switches, spurs, loops and storage areas with this device and it can be adapted to various carrying capacities by varying the power or number of the magnets utilized. While permanent magnets are disclosed, it will also be possible to use electromagnets. The system has an additional advantage that the magnets can not only climb up on the ramp surface in a longitudinal direction but they can also slide off sideways which assists in some cases where the device is moving around a curve.

Other objects and features of the invention will be apparent in the following description of the invention, together with an enabling disclosure wherein the principles of the invention are set forth in connection with the best mode presently contemplated for the practice of the invention.

DRAWINGS accompany the disclosure and the various views thereof may be briefly described as:

FIG. 1, a side view of the various elements of a conveyor.

FIG. 2, a sectional view of the invention.

FIG. 3, a detailed view of the magnetic holding device.

FIG. 4, a detail of a modified type of magnetic holder.

This disclosure is directed to persons skilled in the art of conveyor devices and in the metal working art of manufacturing such devices.

REFERRING TO THE DRAWINGS: In FIG. 1, there is illustrated a power track 20 which carries a drive chain 22 supported on the flanges of the track 20 by vertical trolley links 24 having rollers 26. Below and to one side of the track 20 is a load or carrier track 30 which supports load cars or transfer mechanisms 32 on opposed rollers 34 riding on the flanges of the carrier track 30. Any suitable type of load carrying suspension yoke 36 can be provided to support a load as shown in FIG. 1.

Suspended on the bottom of the links 24 are pick-up dogs 40 which consist of one leg 42 which is pivoted to the bottom of the links 24 by a pin 43 and another depending leg 44 which is formed as a bifurcate bracket to house a U-shaped permanent magnet 46. As will be seen in FIGS. 1 and 2, the U-shaped magnet is trapped in the housing by a cross-pin 48 held in place by suitable cotter pins, this pin passing through the bight of the magnet. The two lock screws 50 in the top of the housing 44 can be adjusted to cooperate with shoulders 52. Thus, it will be seen that the magnets 46 have at each end flat surfaces which lie in the same plane and they are mounted to move up and down with the pivoted dog 40 and also to rotate around the pin 48.

Mounted on the top of the body of the load car 32 is a ramp plate 60, this being mounted on two vertical angle bars 62 and 64 held in place by suitable welds or bolts (not shown).

It will be noted also that the plate 60, which has been referred to as a ramp, is provided with a trailing surface 70 which is angled to the lineal direction of the tracks 20 and 30 and so positioned relative to the pick-up dogs 40 that they will move on to the plate with gradual contact and the magnets may then contact the surface of the magnetic ramp 70 to accelerate the load car 32 and move it up to the velocity of the drive chain 22. As this happens, it will be noted that the angle of the drive dogs 40 may change as the devices move up the slope. When it is desired to free the particular carrier from the magnets, it can simply be stopped so that the magnets will slide off from the leading end of the plates 60 or if the car is taken around a curve, the chain may be going in an opposite direction and the magnets will slide off the side of the plate 60. Automatic switches and various other traditional devices in the conveyor art can be utilized for the flexibility of operation as desired.

In FIG. 4, a modified magnetic structure is shown in which an arched magnetic element 80 has an integral arm 82 which is pivoted at 84 to a support 24.

The magnet 80 is also pivoted to the arm 82 at 84 on an offset projection shoulder 90. This double pivot 84, 92 with the offset shoulder 90 positions the magnet so it will be properly oriented to have an acceptable attitude to the slide approach ramp 70.

It will thus be seen that the drive mechanism above described can operate in such a way that the magnets slide silently on to the magnetic ramp surface so that the carrier car is picked up without shock gradually accelerated to the speed of the drive and then discharged at any desired point. The pivotal dislocation of the magnetic ramp permits any car to be bypassed by the magnets as the drive chain moves along any particular track. Thus, load selection, by-passing, or load deposit can be accomplished by guiding the load hanger or stopping it, so that the magnets will simply slide off the ramp plate 60 without the necessity for any latch devices, clamps, cams, or moving stop mechanisms.

I claim:

1. A power and free conveyor system which comprises:

(a) a power track and a drive chain supported to move along said track, (b) a carrier track mounted colinearly with said power track, (c) a plurality of dogs on said drive chain having a limited pivotal relation thereto, (d) a magnet device on an exterior surface of each said dog, (e) a load car movably supported on said carrier track, (f) a ramp surface of magnetically attractable material mounted on said load car having a disposition generally aligned with the direction of said carrier track, said dog being disposed relative to said ramp surface to bring said magnets into contact with said surface to cause acceleration of said load car to the velocity of said drive chain, and (g) said magnet devices comprising U-shaped pieces having spaced ends with surfaces lying in a plane, and means to mount said pieces for limited motion around the bight to insure proper contact with a ramp surface.

2. A power and free conveyor system which comprises:

(a) a power track and a drive chain supported to move along said track, (b) a carrier track mounted colinearly with said power track, (c) a plurality of dogs on said drive chain having a limited pivotal relation thereto, (d) a magnet device on an exterior surface of each said dog, (e) a load car movably supported on said carrier track, (f) a ramp surface of magnetically attractable material mounted on said load car having a disposition generally aligned with the direction of said carrier track, said dog being disposed relative to said ramp surface to bring said magnets into contact with said surface to cause acceleration of said load car to the velocity of said drive chain, and (g) said magnet devices comprising a U-shaped piece pivotally suspended on a shoulder offset from the center of said U to present the magnet ends for a common approach to said ramp surface.

3. A power and free conveyor system which comprises:

(a) a power track and a drive chain supported to move along said track, (b) a carrier track mounted colinearly with said power track, (c) a plurality of depending dogs on said drive chain having a limited pivotal relation thereto, (d) a magnet device returned on and movably related to a lower surface of each said dog, (e) a load car movably supported on said carrier track, (f) an upwardly disposed ramp surface of magnetically attractable material mounted on said load car having a disposition generally aligned with the direction of said carrier track, said dog being disposed relative to said ramp surface to bring said magnets into contact with said surface to cause acceleration of said load car to the velocity of said drive chain, (g) said ramp surface having a trailing end angled to the general lineal direction of movement of said load car to provide a cam surface to contact said magnet devices as they are moved by said drive chain over said ramp surface, and (h) said trailing end of said ramp surface blending into a surface substantially parallel to the lineal direction of movement of said load cars on said carrier track (i) whereby said movably mounted magnets adjust to the change of angle of said ramp as they move from the angled ramp surface to the surface parallel to the linear direction.

4. A power and free conveyor system which comprises:

(a) a power track and a drive chain supported to move along said track, (b) a carrier track mounted colinearly with said power track, (c) a plurality of pivotally suspended dogs on said drive chain having a channel-shaped pendant portion open at the bottom, (d) a support pin transfixing the sides of said channel portion, (e) a U-shaped magnet suspended on the bight over said support pin between the sides of said channel, the ends of the magnet projecting outwardly below said sides, (f) a load car movably supported on said carrier track, and (g) a ramp surface of magnetically attractable material mounted on said load car having a disposition generally aligned with the direction of said carrier track, said dog being disposed relative to said ramp surface to bring magnet ends into contact with said surface to cause acceleration of said load car to the velocity of said drive chain.

5. A power and free conveyor system as defined in claim 4 which includes positoning lugs formed on the respective legs of said magnet, and screws mounted in the base of said channel adjustably projecting into the space between said channel sides to limit the rocking motion of said magnet on said support pin and assist in the orientation of said magnet ends relative to said ramp surface.

* * * * *